US009322590B1

(12) United States Patent
Phillips et al.

(10) Patent No.: US 9,322,590 B1
(45) Date of Patent: Apr. 26, 2016

(54) REFRIGERATOR APPLIANCE WITH A FINGER GUARD

(71) Applicant: General Electric Company, Schenectady, NY (US)

(72) Inventors: Stuart McVey Phillips, Louisville, KY (US); Stewart Christopher Keeling, Louisville, KY (US); Steven David Paul, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/524,176

(22) Filed: Oct. 27, 2014

(51) Int. Cl.
*F25D 23/02* (2006.01)
*F25D 23/08* (2006.01)

(52) U.S. Cl.
CPC ..... *F25D 23/028* (2013.01); *F25D 23/02* (2013.01); *F25D 23/08* (2013.01)

(58) Field of Classification Search
CPC ..... F25D 23/02; F25D 23/08; F25D 23/028; E05D 11/00
USPC ..... 312/401, 405, 326, 329, 138.1; 16/250, 16/251; 49/383
See application file for complete search history.

(56) References Cited

U.S. PATENT DOCUMENTS

| | | | | |
|---|---|---|---|---|
| 2,015,186 | A * | 9/1935 | Kauzor | 49/383 |
| 3,319,697 | A * | 5/1967 | Krohn | 160/229.1 |
| 5,564,808 | A | 10/1996 | Gipson, Jr. et al. | |
| 6,298,605 | B1 * | 10/2001 | Delefosse et al. | 49/383 |
| 6,997,530 | B2 * | 2/2006 | Avendano et al. | 312/401 |
| 8,104,143 | B2 | 1/2012 | Heger et al. | |
| 2009/0261703 | A1 * | 10/2009 | Kentner et al. | 312/405 |
| 2010/0045150 | A1 * | 2/2010 | Laible et al. | 312/237 |
| 2012/0080991 | A1 * | 4/2012 | Wilson | 312/405 |

* cited by examiner

*Primary Examiner* — James O Hansen
(74) *Attorney, Agent, or Firm* — Dority & Manning, P.A.

(57) ABSTRACT

A refrigerator appliance with a finger guard is provided. The finger guard includes a base plate positioned on and mounted to a cabinet of the refrigerator appliance. The finger guard also includes an arcuate plate mounted to the base plate. The arcuate plate extends away from the cabinet. An outer side edge of the door may sweep along the arcuate plate during opening and closing of the door.

18 Claims, 5 Drawing Sheets

REFRIGERATOR APPLIANCE WITH A FINGER GUARD

FIELD OF THE INVENTION

The present subject matter relates generally to refrigerator appliances and finger guards for the same.

BACKGROUND OF THE INVENTION

When a door swings relative to a stationary frame, a gap between the door and the stationary frame at a hinge side of the stationary frame opens and closes. As the gap closes, objects within the gap can be pinched or crushed between the door and stationary frame. For example, an unwary user or child may place their hand or fingers within the gap and, upon closing the door, a serious injury can result.

Refrigerator appliances with hinge mounted swinging doors are not immune to the problem. For example, a crush zone can be created between the hinge side of the refrigerator door and an adjacent cabinet or other article. In particular, flush-mount refrigerator appliances having side-by-side doors that are mounted flush with a front plane of adjacent cabinets can have such crush zones.

Accordingly, a refrigerator appliance with features for protecting user appendages during opening and closing of a door of the refrigerator appliance would be useful. Thus, a refrigerator appliance with a finger guard would be useful. In particular, a flush-mount refrigerator appliance with a finger guard would be useful.

BRIEF DESCRIPTION OF THE INVENTION

The present subject matter provides a refrigerator appliance with a finger guard. The finger guard includes a base plate positioned on and mounted to a cabinet of the refrigerator appliance. The finger guard also includes an arcuate plate mounted to the base plate. The arcuate plate extends away from the cabinet. An outer side edge of the door may sweep along the arcuate plate during opening and closing of the door. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that extends between a first side portion and a second side portion. The cabinet defines a chilled chamber. The refrigerator appliance also includes a hinge. A door is mounted to the cabinet with the hinge at the first side portion of the cabinet. The door is rotatable on the hinge between an open position and a closed position. The door has an outer side edge. A finger guard is positioned at the first side portion of the cabinet. The finger guard includes a base plate positioned on and mounted to the cabinet. An arcuate plate is mounted to the base plate. The arcuate plate extends between a proximal end portion and a distal end portion. The proximal end portion of the arcuate plate is positioned at the base plate. The distal end portion of the arcuate plate is spaced apart from the base plate. The distal end portion of the arcuate plate is positioned closer to the outer side edge of the door than the proximal end portion of the arcuate plate when the door is in the closed position.

In a second exemplary embodiment, a refrigerator appliance is provided. The refrigerator appliance defines a vertical direction and a lateral direction that are perpendicular to each other. The refrigerator appliance includes a cabinet that defines an opening for accessing a chilled chamber within the cabinet. A hinge is mounted to the cabinet. A door is mounted to the hinge at the opening of the cabinet. The door is rotatable on the hinge between an open position and a closed position. The door has an outer side edge that is spaced apart from the cabinet along the lateral direction when the door is in the closed position. A finger guard is positioned proximate the outer side edge of the door and the opening of the cabinet. The finger guard includes a base plate positioned on and mounted to the cabinet. An arcuate plate is mounted to the base plate and extends arcuately from the base plate towards the outer side edge of the door when the door is in the closed position. The base plate has a distal end portion that is spaced apart from the cabinet along the lateral direction.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
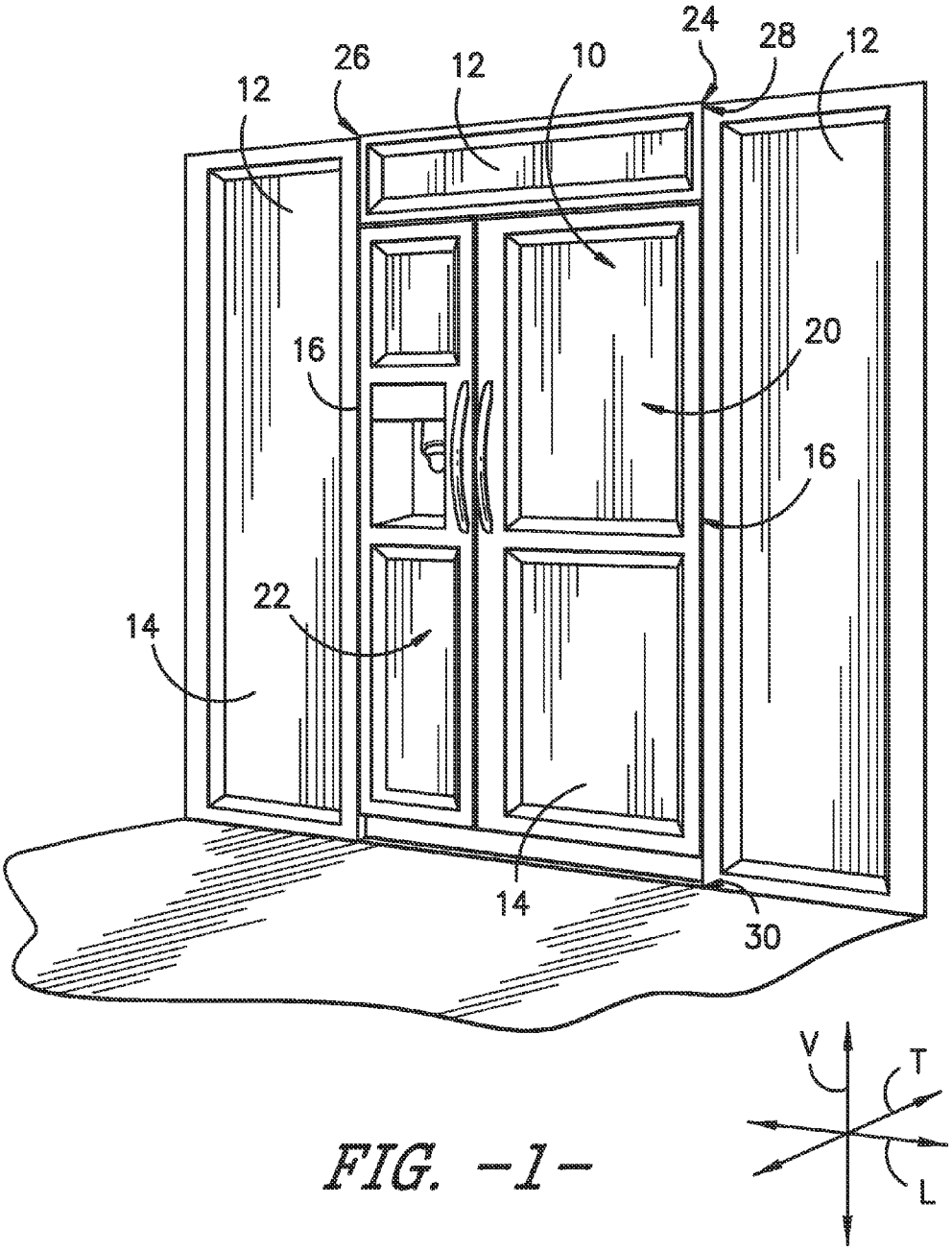
FIG. 1 provides a perspective view of a refrigerator appliance according to an exemplary embodiment of the present subject matter positioned within cabinetry.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
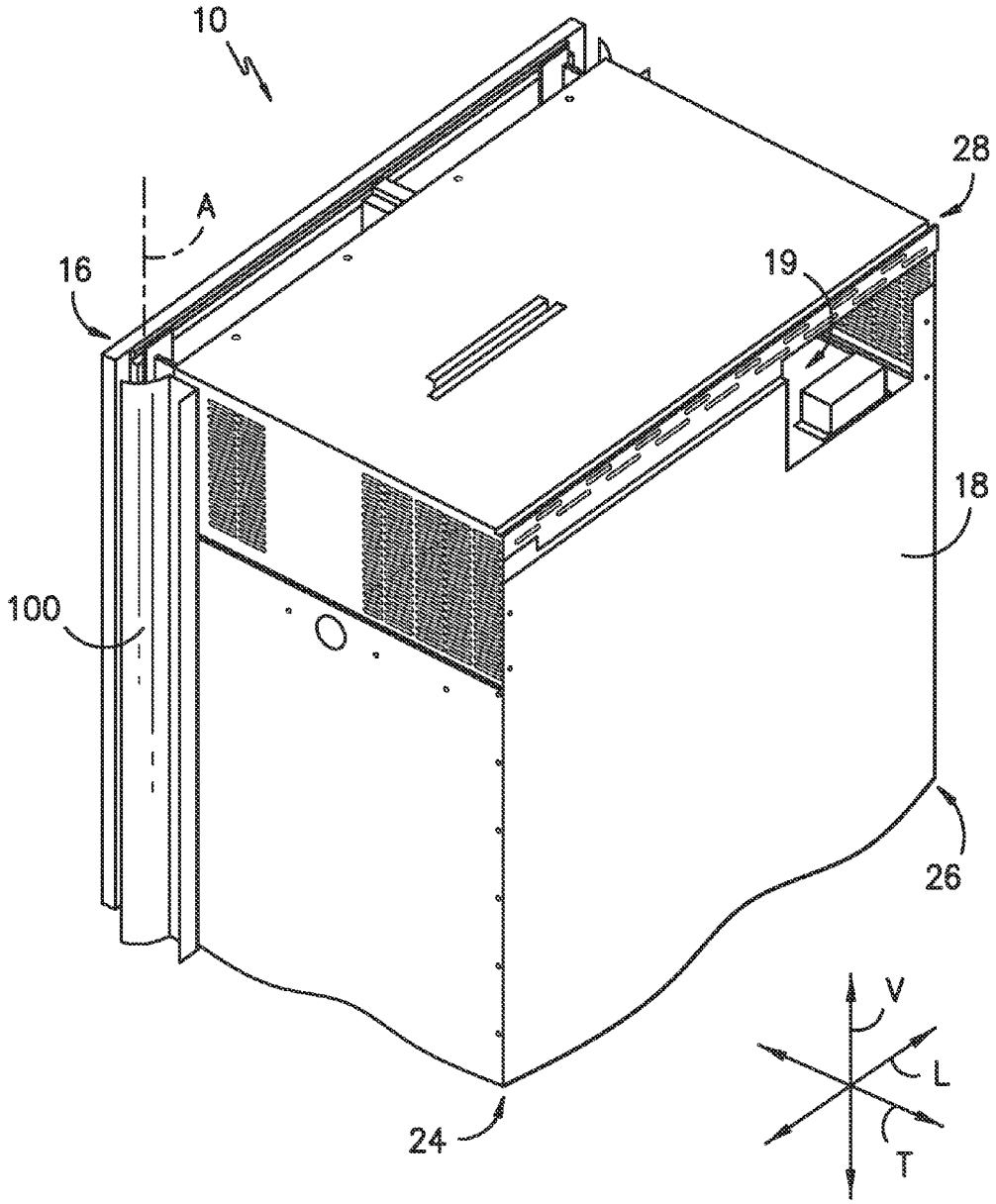
FIG. 2 provides a rear, partial perspective view of the exemplary refrigerator appliance of FIG. 1.
Figure 3:
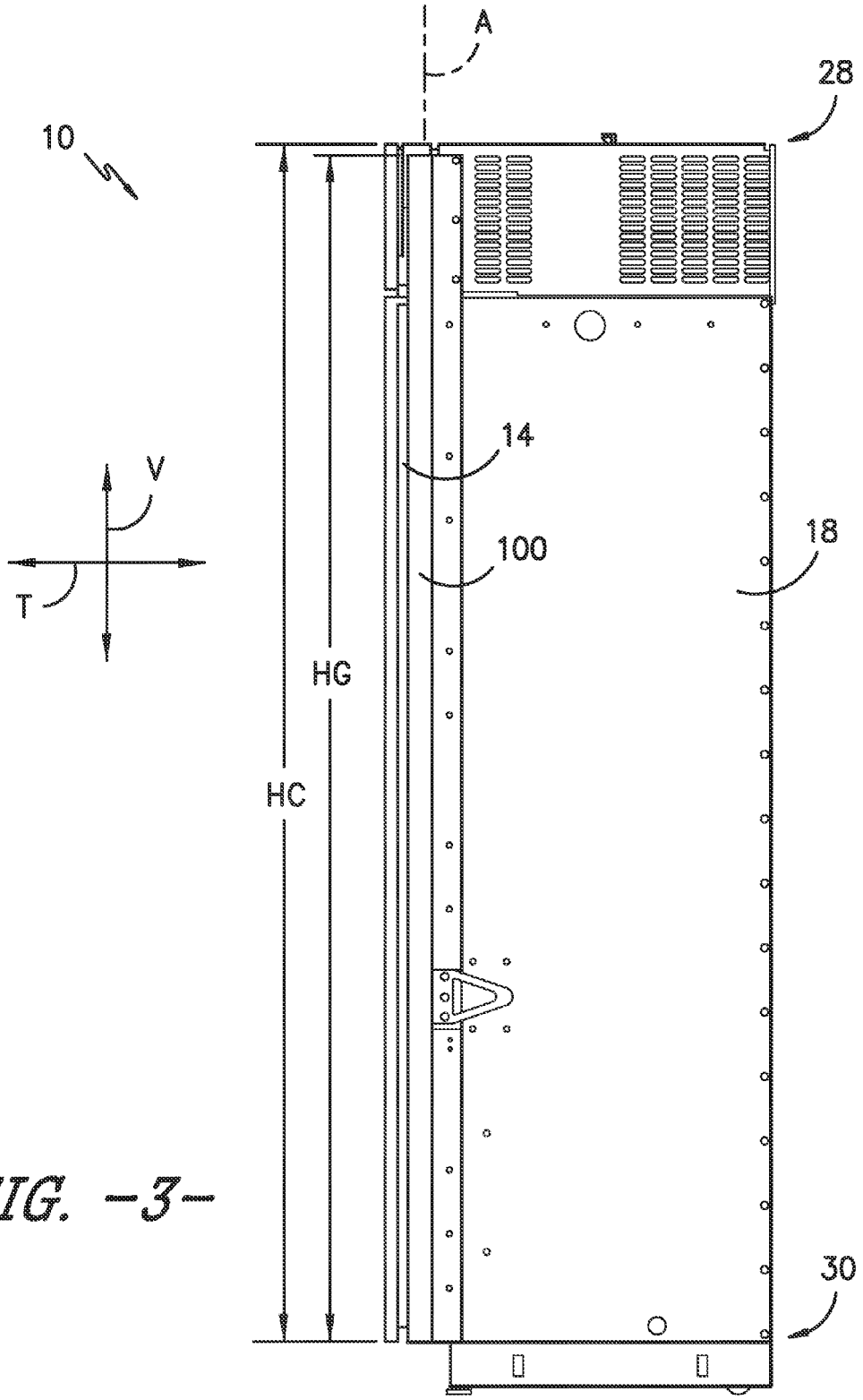
FIG. 3 provides a side, elevation view of the exemplary refrigerator appliance of FIG. 1.

FIG. 1 provides a perspective view of a refrigerator appliance 10 according to an exemplary embodiment of the present subject matter positioned within cabinetry 12. FIG. 2 provides a rear, partial perspective view of refrigerator appliance 10. FIG. 3 provides a side, elevation view of refrigerator appliance 10. Refrigerator appliance 10 is generally referred to as a "flush-mounted refrigerator appliance" because a front of the refrigerator appliance 10 lies essentially flush with a front of adjacent cabinetry 12, as is well understood by those skilled in the art. Refrigerator appliance 10 defines a vertical direction V, a lateral direction L and a transverse direction T. The vertical direction V, the lateral direction L and the transverse direction T are mutually perpendicular and form an orthogonal direction system.

As may be seen in FIGS. 2 and 3, refrigerator appliance 10 includes a cabinet or casing 18. Casing 18 extends between a first side portion 24 and a second side portion 26, e.g., along the lateral direction L. Casing 18 also extends between a top portion 28 and a bottom portion 30, e.g., along the vertical direction V. Casing 18 defines a fresh food storage compartment 20 and a freezer storage compartment 22. Fresh food compartment 20 may be positioned at or adjacent first side portion 24 of casing 18, and freezer compartment 22 may be positioned at or adjacent second side portion 26 of casing 18. Thus, fresh food compartment 20 and freezer compartment 22 are arranged side-by-side within casing 18. It should be understood that fresh food compartment 20 and freezer compartment 22 may have nay other suitable arrangement in alternative exemplary embodiments. Refrigerator appliance 10 also includes a machinery compartment 19 positioned at or adjacent top portion 28 of casing 18 that incorporates at least part of a sealed refrigeration system (not shown). The sealed refrigeration system includes various components for generating chilled air within the fresh food and freezer compartments 20, 22, as will be understood by those skilled in the art.

As may be seen in FIG. 1, refrigerator appliance 10 also includes doors 14 that rotate relative to casing 18 along a hinge side 16 of casing 18. As may be seen in FIGS. 2 and 3, refrigerator appliance 10 also includes a finger guard 100. Finger guard 100 is deployed or positioned along hinge side 16 of casing 18, e.g., in order to hinder or prevent a person from accidentally inserting their hand or fingers behind door 14 when door 14 is open. It should be appreciated that finger guard 100 may also be incorporated on casing 18 at or adjacent the opposite side of casing 18.

Turning to FIG. 3, casing 18 defines a height HC, e.g., between the top and bottom portions 28, 30 of casing 18, along the vertical direction V. Finger guard 100 also defines a height HG along the vertical direction V. The height HG of finger guard 100 may be about equal to the height HC of casing 18. For example, the height HG of finger guard 100 may be within ten percent of the height HC of casing 18. Thus, finger guard 100 may extend vertically along the height HC of casing 18. In such a manner, finger guard 100 may hinder or prevent a person from accidentally inserting their hand or fingers behind door 14 when door 14 is open along about the entire height HC of casing 18 and/or provide a pleasant cosmetic appearance.

Figure 4:
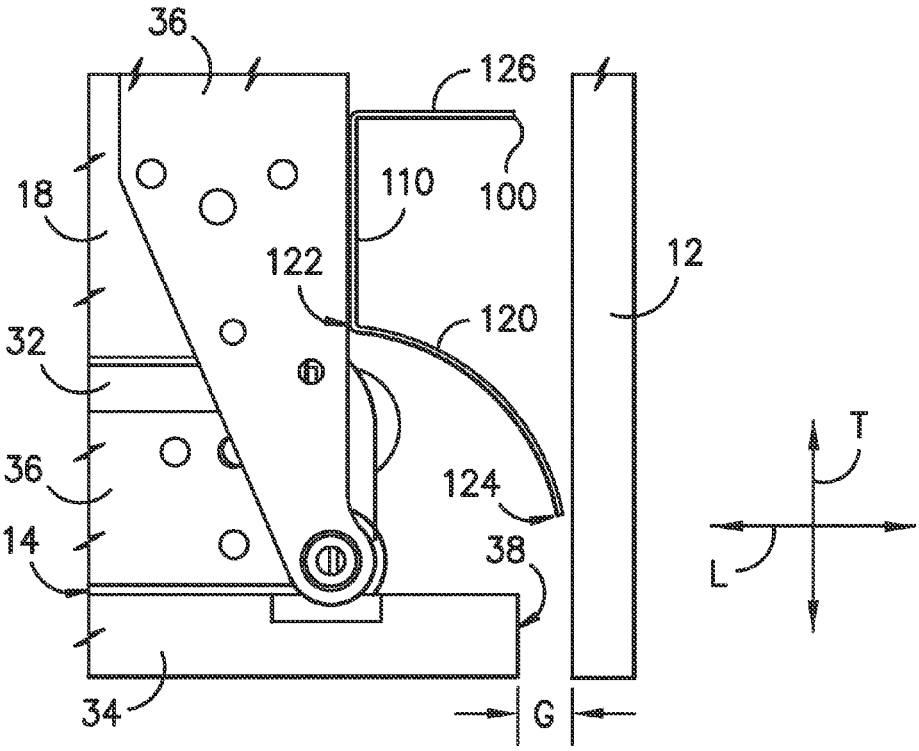
FIGS. 4, 5 and 6 provide top, plan views of a door and finger guard of the exemplary refrigerator appliance of FIG. 1 with the door shown in various positions.
Figure 5:
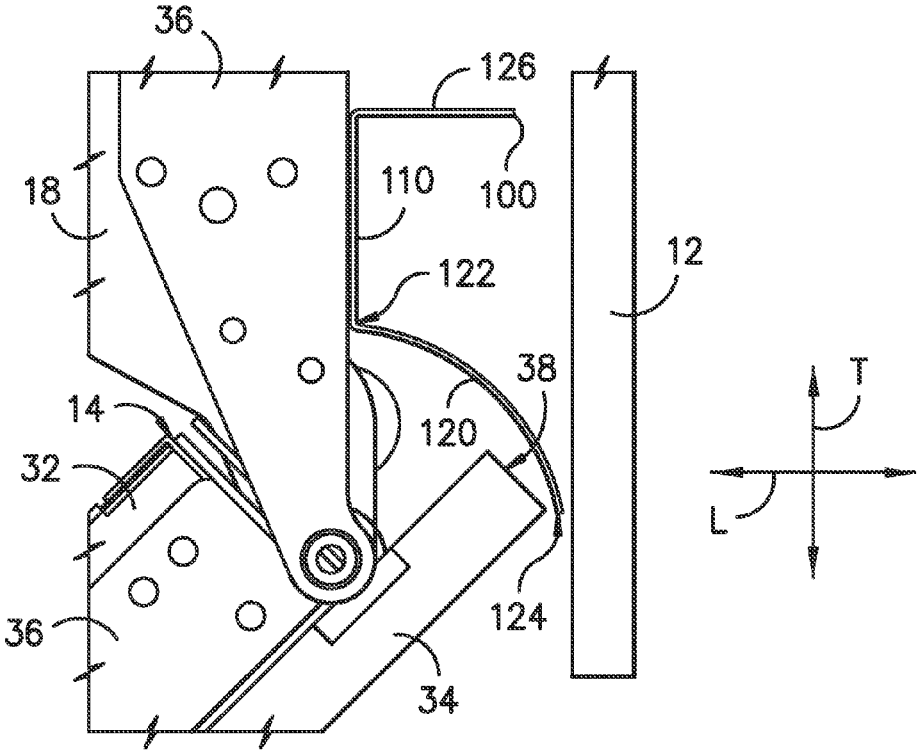
Figure 6:
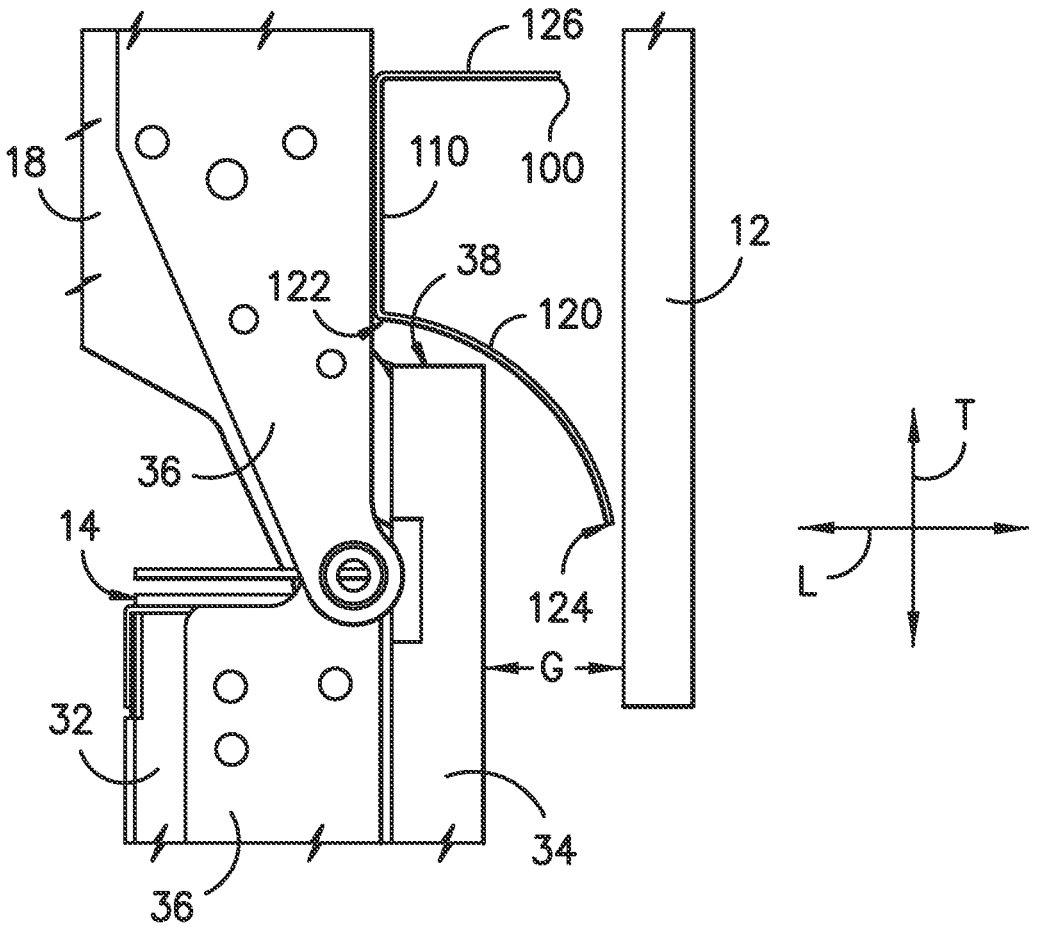

FIGS. 4, 5 and 6 provide top, plan views of door 14 and finger guard 100 of refrigerator appliance 10 with door 14 shown in various positions. In FIG. 4, door 14 is shown in a closed position relative to casing 18. Door 14 is shown in an open position relative to casing 18 in FIG. 6. In FIG. 5, door 14 is shown positioned between the open and closed positions. A user may selectively adjust door 14 between the open and closed positions, e.g., by pulling on door 14 and/or a handle of door 14.

As may be seen in FIGS. 4, 5 and 6, door 14 includes an inner door casing 32 and an outer door panel 34. Outer door panel 34 may be a decorative door panel, such as a wood door panel, that is attached by any suitable means to inner door casing 32. Outer door panel 34 may also have an appearance that matches the style of adjacent cabinetry 12, as may be seen in FIG. 1. Inner door casing 32 may be constructed of any suitable material, such an inner plastic liner and an outer metal casing, and engage casing 18 when door 14 is closed in order to seal fresh food compartment 20 (or freezer compartment 22).

Refrigerator appliance 10 also includes a hinge 36. Door 14 is rotatably mounted to casing 18 with hinge 36, e.g., at first side portion 24 of casing 18. Thus, door 14 is rotatable on hinge 36 between the open and closed positions. Hinge 36 is a non-articulating hinge in the exemplary embodiment shown in FIGS. 4, 5 and 6, e.g., such that door 14 only rotates relative to casing 18 when door 14 is adjusted between the open and closed position. However, hinge 36 may be an articulating hinge in alternative exemplary embodiments, e.g., such that door 14 both rotates relative to casing 18 and moves away from casing 18 along the transverse direction T when door 14 is adjusted between the open and closed position.

Door 14 also has an outer side edge 38. For example, outer door panel 34 may define outer side edge 38 of door 14, as shown in FIGS. 4, 5 and 6. Outer door panel 34 may extend past first side portion 24 of casing 18, e.g., along the lateral direction L, when door 14 is in the closed position, as shown in FIG. 4, such that outer side edge 38 of door 14 is spaced apart from casing 18, e.g., along the lateral direction L, when door 14 is in the closed position. In particular, outer panel 34 may extend past first side portion 24 of casing 18 by at least one inch along the lateral direction L when door 14 is in the closed position.

As discussed above, finger guard 100 may assist with hindering or preventing a person from accidentally inserting their hand or fingers behind door 14 when door 14 is open. As shown in FIG. 4, door 14, e.g., outer side edge 38 of door 14, and cabinetry 12 define a gap G, e.g., along the lateral direction L, when door 14 is in the closed position. The gap G may be sized such that a person may not insert their hand or fingers through the gap G when door 14 is in the closed position. Conversely, turning to FIG. 6, the gap G increases in size when door 14 is moved to the open position. Thus, a person may insert their hand or fingers between door 14 and cabinetry 12 when door 14 is in the open position. Finger guard 100 includes features for sweeping hands and fingers from between door 14 and cabinetry 12 when door 14 is moved from the open position to the closed potion, as discussed in greater detail below.

As may be seen in FIGS. 4, 5 and 6, finger guard 100 includes a base plate 110 and an arcuate plate 120. Base plate 110 is positioned on and mounted to casing 18. Arcuate plate 120 is mounted to base plate 110 and extends arcuately from base plate 110, e.g., towards outer side edge 38 of door 14 when door 14 is in the closed position. Arcuate plate 120 extends between a proximal end portion 122 and a distal end portion 124. Proximal end portion 122 of arcuate plate 120 is positioned at base plate 110, and distal end portion 124 of arcuate plate 120 is spaced apart from base plate 110, e.g., along the lateral direction L. As may be seen in FIG. 4, distal end portion 124 of arcuate plate 120 is positioned closer to outer side edge 38 of door 14 than proximal end portion 122 of arcuate plate 120, e.g., along the transverse direction T, when door 14 is in the closed position. Distal end portion 124 of arcuate plate 120 may also be positioned adjacent (e.g., within less than about a quarter of an inch of) or in contact with cabinetry 12. Thus, arcuate plate 120 may block a person from inserting their hand or fingers between casing 18 of refrigerator appliance 10 and adjacent cabinetry 12 past finger guard 100 along the transverse direction T.

As may be seen in FIGS. 5 and 6, outer side edge 38 of door 14 sweeps along arcuate plate 120 as door 14 moves between the open and closed positions. Thus, as may be seen in FIG. 6, outer side edge 38 of door 14 is positioned adjacent arcuate plate 120. For example, outer side edge 38 of door 14 may be spaced apart from the arcuate plate 120 by less than a quarter of an inch, e.g., along at least one of the lateral direction L and the transverse direction T, when door 14 is in the open position. As another example, outer side edge 38 of door 14 may be spaced apart from the arcuate plate 120 by less than an eighth of an inch, e.g., along at least one of the lateral direction L and the transverse direction T, when door 14 is in the open position. Turning back to FIG. 3, hinge 36 an axis of rotation A about which door 14 is rotatable. Proximal end portion 122 of arcuate plate 120 and distal end portion 124 of arcuate plate 120 are positioned about (e.g., within ten percent of) equidistant from the axis of rotation A of hinge 36. Thus, the distance between outer side edge 38 of door 14 and arcuate plate 120 may be about constant as door 14 moves between the open and closed positions.

As may be seen in FIGS. 5 and 6, outer side edge 38 of door 14 sweeps along arcuate plate 120 as door 14 is moved from the open position towards the closed position. Thus, if a person has hands and fingers positioned at outer side edge 38 of door 14, the door 14 sweeps the fingers or hands along arcuate plate 120 as the door moves from the open position towards the closed position. In such a manner, the fingers may not be crushed within the gap G between door 14 and cabinetry 12 when door 14 is in the closed position.

Finger guard 100 also includes a stop plate 126. Stop plate 126 is mounted to base plate 110 and extends, e.g., perpendicularly, from base plate 100. Stop plate 126 is positioned opposite arcuate plate 120 on base plate 110. Stop plate 126 may engage or impact a stop block or other suitable component of cabinetry 12 when refrigerator appliance 10 is inserted between cabinetry 12 as shown in FIG. 1. In such a manner, stop plate 126 may assist with properly or suitably positioning refrigerator appliance 10 relative to cabinetry 12, e.g., such that outer door panel 34 is flush with doors of cabinetry 12.

Finger guard 100 may be constructed of or with any suitable, e.g., rigid, material. For example, finger guard 100 may be formed of a single continuous piece of metal or plastic. Thus, finger guard 100 may be formed of a single piece of molded plastic, a single piece of extruded aluminum, or a single piece of folded stainless steel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a lateral direction and a transverse direction that are perpendicular to each other, the cabinet extending along the lateral direction between a first side portion and a second side portion, the cabinet defining a chilled chamber;

a hinge extending along the transverse direction away from the cabinet;

a door mounted to the cabinet with the hinge at the first side portion of the cabinet, the door rotatable on the hinge between an open position and a closed position, the door having an outer panel defining an outer side edge, the outer panel extending past the first side portion of the cabinet along the lateral direction when the door is in the closed position; and a finger guard positioned behind the outer panel along the transverse direction when the door is in the closed position at the first side portion of the cabinet, the finger guard comprising;

a base plate positioned on and mounted to the cabinet; and an arcuate plate mounted to the base plate, the arcuate plate extending between a proximal end portion and a distal end portion, the proximal end portion of the arcuate plate positioned at the base plate, the distal end portion of the arcuate plate spaced apart from the base plate, the distal end portion of the arcuate plate positioned closer to the outer side edge of the door than the proximal end portion of the arcuate plate when the door is in the closed position.

2. The refrigerator appliance of claim 1, wherein the refrigerator appliance defines a vertical direction, the cabinet defining a height along the vertical direction, the finger guard also defining a height along the vertical direction, the height of the finger guard being within ten percent of the height of the cabinet.

3. The refrigerator appliance of claim 1, wherein the outer side edge is spaced apart from the arcuate plate by less than a quarter of an inch when the door is in the open position.

4. The refrigerator appliance of claim 3, wherein the outer side edge is spaced apart from the arcuate plate by less than an eighth of an inch when the door is in the open position.

5. The refrigerator appliance of claim 3, wherein the outer side edge is spaced apart from the arcuate plate by less than a quarter of an inch when the door is positioned between the open and closed positions.

6. The refrigerator appliance of claim 1, wherein the hinge defines an axis of rotation, the proximal end portion of the arcuate plate and the distal end portion of the arcuate plate positioned about equidistant from the axis of rotation of the hinge.

7. The refrigerator appliance of claim 1, wherein the outer panel extends past the first side portion of the cabinet by at least one inch along the lateral direction when the door is in the closed position.

8. The refrigerator appliance of claim 1, when the outer panel is a wood outer panel.

9. The refrigerator appliance of claim 1, wherein the finger guard further comprises a stop plate extending perpendicularly from the base plate, the stop plate positioned opposite the arcuate plate on the base plate.

10. The refrigerator appliance of claim 1, wherein the finger guard is constructed of a single continuous piece of metal or plastic.

11. A refrigerator appliance defining a vertical direction, a transverse direction and a lateral direction that are mutually perpendicular to one another, the refrigerator appliance comprising:

a cabinet defining an opening for accessing a chilled chamber within the cabinet;

a hinge mounted to the cabinet and extending away from the cabinet along the transverse direction;

a door mounted to the hinge at the opening of the cabinet, the door rotatable on the hinge between an open position and a closed position, the door having an outer panel that defines an outer side edge, the outer panel of the door extending past the cabinet proximate the hinge such that the outer side edge of the outer panel is spaced apart from the cabinet along the lateral direction when the door is in the closed position; and a finger guard positioned proximate the outer side edge of the door and the opening of the cabinet, the finger guard positioned behind the outer panel along the transverse direction when the door is in the closed position, the finger guard comprising a base plate positioned on and mounted to the cabinet; and an arcuate plate mounted to the base plate and extending arcuately from the base plate towards the outer side edge of the outer panel along the transverse direction when the door is in the closed position, the arcuate plate having a distal end portion that is spaced apart from the outer side edge of the outer panel along the lateral direction when the door is in the closed position.

12. The refrigerator appliance of claim 11, wherein the cabinet defines a height along the vertical direction, the finger guard also defining a height along the vertical direction, the height of the finger guard being about equal to the height of the cabinet.

13. The refrigerator appliance of claim 11, wherein the outer side edge is spaced apart from the arcuate plate by less than a quarter of an inch when the door is in the open position.

14. The refrigerator appliance of claim 13, wherein the outer side edge is spaced apart from the arcuate plate by less than an eighth of an inch when the door is in the open position.

15. The refrigerator appliance of claim 11, wherein the hinge defines an axis of rotation, the arcuate plate positioned about equidistant from the axis of rotation of the hinge.

16. The refrigerator appliance of claim 11, wherein the outer panel is a wood outer panel.

17. The refrigerator appliance of claim 11, wherein the finger guard further comprises a stop plate extending perpendicularly from the base plate, the stop plate positioned opposite the arcuate plate on the base plate.

18. The refrigerator appliance of claim 11, wherein the finger guard is constructed of a single continuous piece of metal or plastic.

* * * * *